US011180300B2

(12) United States Patent
Abramov

(10) Patent No.: US 11,180,300 B2
(45) Date of Patent: Nov. 23, 2021

(54) DEGRADABLE ARTICLE

(71) Applicant: Igor Abramov, Vista, CA (US)

(72) Inventor: Igor Abramov, Vista, CA (US)

( * ) Notice: Subject to any disclaimer, the term of this patent is extended or adjusted under 35 U.S.C. 154(b) by 255 days.

(21) Appl. No.: 16/684,594

(22) Filed: Nov. 15, 2019

(65) Prior Publication Data

US 2020/0156839 A1 May 21, 2020

Related U.S. Application Data

(60) Provisional application No. 62/768,554, filed on Nov. 16, 2018.

(51) Int. Cl.
*B65D 3/06* (2006.01)
*B65D 65/46* (2006.01)

(52) U.S. Cl.
CPC ..... *B65D 65/466* (2013.01); *B65D 3/06* (2013.01)

(58) Field of Classification Search
CPC ..... B65D 3/06; B65D 65/466; C08L 5/08; C08L 2201/06; C08L 2205/03; A47G 21/18; A47G 21/181; A47G 21/182; A47G 21/183; A47G 21/184; A47G 21/185; A47G 21/186; A47G 21/187; A47G 21/188; A47G 21/189
USPC ..... 206/524.2; 239/33
See application file for complete search history.

(56) References Cited

U.S. PATENT DOCUMENTS 2,040,880 A * 5/1936 Rigby ..... D01F 4/00 536/20
5,010,181 A * 4/1991 Coughlin ..... B01J 20/24 210/668
7,291,664 B2 * 11/2007 Hao ..... C08L 89/005 524/414
2002/0030115 A1 * 3/2002 Float ..... A47G 21/187 239/33
2004/0005385 A1 * 1/2004 Emig ..... A23L 2/52 426/86
2007/0292643 A1 * 12/2007 Renn ..... B65D 25/34 428/35.7
2012/0160928 A1 * 6/2012 Jo ..... A47G 21/183 239/33
2014/0221528 A1 * 8/2014 Ribi ..... G01K 11/12 523/351
2020/0022516 A1 * 1/2020 Tsai ..... C08L 75/04
2020/0054157 A1 * 2/2020 Wu ..... A47G 21/18
2020/0154919 A1 * 5/2020 Abramov ..... C08B 37/003
2020/0156839 A1 * 5/2020 Abramov ..... B65D 3/06
2020/0253403 A1 * 8/2020 Huang ..... B29C 48/09
2020/0305623 A1 * 10/2020 Steele ..... B32B 7/12

FOREIGN PATENT DOCUMENTS

WO WO-2007012142 A1 * 2/2007 ..... C08L 5/08
WO WO-2020174234 A1 * 9/2020 ..... C08L 5/00
WO WO-2021046041 A1 * 3/2021 ..... B29C 48/05
WO WO-2021095002 A1 * 5/2021 ..... B65D 77/28

* cited by examiner

*Primary Examiner* — Joshua E Rodden

(57) ABSTRACT

Degradable water- and oil-resistant article is made of chitin and contains water-activated chitin-degrading enzyme or enzymes. Initially supplied in an inactive lyophilized (dry) form, the enzyme or enzymes upon exposure to water present in ambient environment degrade chitin-based article to chitosan, a benign compound. Several article embodiments presented, some with water ingress retardant features.

17 Claims, 8 Drawing Sheets

DEGRADABLE ARTICLE

FIELD OF INVENTION

This invention relates in general to disposable and degradable containers, and in particular to disposable degradable beverage and food containers.

BACKGROUND OF INVENTION

At present, majority of disposable food- and beverage packaging, containers and utensils are made of artificial polymer- or specially treated paper-based materials. Items made from these materials present an environmental problem when disposed, since they consume valuable volume in landfills and require considerable time to degrade. Recycling such items has also been problematic, as some of them are not recyclable due to the nature of the constituent materials, such as thermo-set plastics, some items are grossly contaminated to become a viable reprocessing stock, and some are made with materials which are incompatible if mixed in general re-processing streams. Sorting and cleaning of the recycled items has generally been deemed impractical due to the costs and logistics involved. As a result, one of the more popular disposal methods has been incineration of these items, but it presents serious environmental problems due to the associated atmospheric emissions and environmental contamination. Societies' concerns about environmental impact of such discarded disposable containers and utensils facilitated looking for ways to either more efficient recycling of these items or making them safely and efficiently degradable.

Previous attempts to develop viable degradable materials have been focused on materials which would be degraded by action of sunlight or of microorganisms found in landfills.

Various treated paper- and starch-based plastic products have been tried for bio- or photo-degradable food packaging items, to largely disappointing results. It has been found that many landfills do not provide enough light or suitable living environments for microorganisms and so the discarded products do not get reliably degraded.

Also, containers and utensils have to be water- and oil-resistant, at least for the duration of their use. They also have to accommodate both hot and cold contents. This presents technical problems for the degradable container design, as these requirements are frequently at odds with each other.

Nevertheless, to meet these requirements, various materials have been used to modify the conventional paper base used for degradable items, such as impregnation with various water- and oil-resistant compounds, such as waxes, or applying water- and oil-resistant surface coatings. These water- and oil-proofing chemicals have to be safe for consumers, offer reasonable protection and be, ideally, degradable. Their degradability, however had been problematic, since it has been shown that even a widely used disposable beverage cup made of waxed paper takes a very long time to degrade in landfills, in the order of ten to twenty years.

OBJECTIVES OF THE INVENTION

Thus, it is the objective of instant invention to provide a food or beverage container that without pre-processing would be reliably degraded in landfills.

Another objective is to provide a container that would not require the action of microorganisms for its degradation.

Yet another objective is to provide a container that would be food- and beverage safe.

Another objective is to provide a container that would be compatible with both hot and cold contents.

Yet another objective is to provide a container that would be impervious to water or oil content for extended, and preferably, unlimited, time.

Another objective is to provide a container that would not affect the taste, dietary fitness or safety of its content.

Yet another objective is to provide a container that upon degradation would produce residues usable in other applications or would be benign or beneficial for the environment.

Another objective is to provide a container that would use inexpensive, abundant and, ideally, renewable materials for its construction.

SUMMARY OF THE INVENTION

In accordance with the present invention, a food or beverage container made of chitin is described. The inner chitin surface of the container is impervious to water- and oil-based content. The container on it outer surface contains desiccated ('lyophilized') enzymes, which, when activated by a contact with an ambient water decompose chitin into chitosan, a water-soluble substance, and thus degrade the container. Enzymes are protected from premature activation by special enzyme-containing compartments design and, optionally, via water ingress retarding means.

Items made of chitin, in the absence of degrading enzymes are water- and oil-resistant virtually indefinitely. Chitosan, on the other hand, is water-soluble, environmentally benign and advantageously used in wide-ranging industrial, medical, biochemical and agricultural applications.

PRIOR ART

The prior art is comprised of methods of preparing films and filaments from chitin (U.S. Pat. No. 2,040,880 to Rigby et al.), food products made from alcoholized chitin (U.S. Pat. No. 2,783,148 to György et al.), photo- and bio-degradable multi-component compounds, some containing chitin (U.S. Pat. No. 7,291,664 to Hao).

There are also methods to enzymatically degrade chitin (U.S. Pat. No. 9,758,802 to Vaaje-Kolstad et al.).

However, none of the prior art above suggests or teaches making food or beverage containers made of chitin which are enzymatically degraded, as per instant invention.

OBJECTS AND ADVANTAGES

In contrast to the prior art mentioned hereinabove, the present invention provides food and beverage containers made of chitin which are degradable by enzymes upon exposure to ambient water. Prior to their being enzymatically degraded, the chitin-based containers are virtually chemically inert and do not chemically affect the content.

The containers are compatible with both cold and hot content.

Chitin is the most abundant aminopolysaccharide polymer occurring in nature, and is the building material that gives strength to the exoskeletons of crustaceans, insects, and the cell walls of fungi. The structure of chitin is shown below (1).

(1)

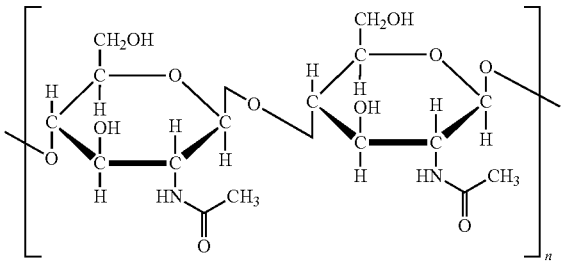

The main natural sources of chitin are shrimp and crab shells, which are an abundant byproduct of the seafood-processing industry and are a renewable resource. Per US Dept. of Commerce, in 1973 alone there were 1.5 million tons of chitin produced as waste from shellfish processing. The chitinous solid waste from shrimping operations in India alone amounted to 80,000 tons in 2004.

Through enzymatic or chemical deacetylation, chitin can be converted to its most well-known derivative, chitosan (2).

(2)

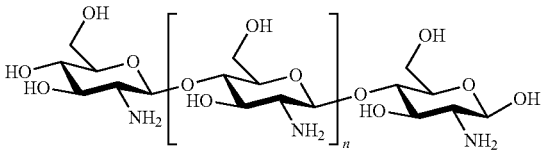

Chitosan, in addition to being water-soluble, has several environmentally beneficial properties, such as biodegrability, biocompatibility and non-toxicity. It is also widely used in biopharmaceuticals, biomedicine, surgical medicine, paint production, animal and fish fodder additives, soil augmentation and growth media.

DESCRIPTION OF THE EMBODIMENTS

In the foregoing description like components are labeled by the like numerals.

Figure 1:
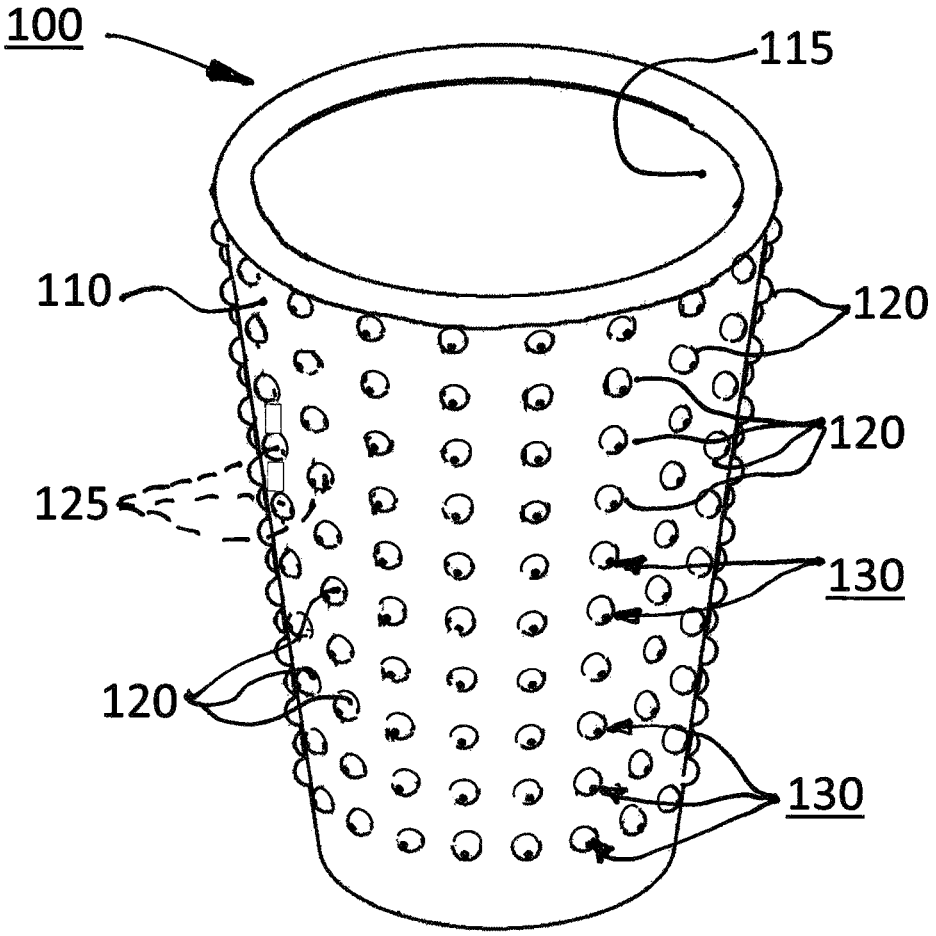
FIG. 1 is a perspective view of the beverage container with enzyme compartments.
Figure 3:
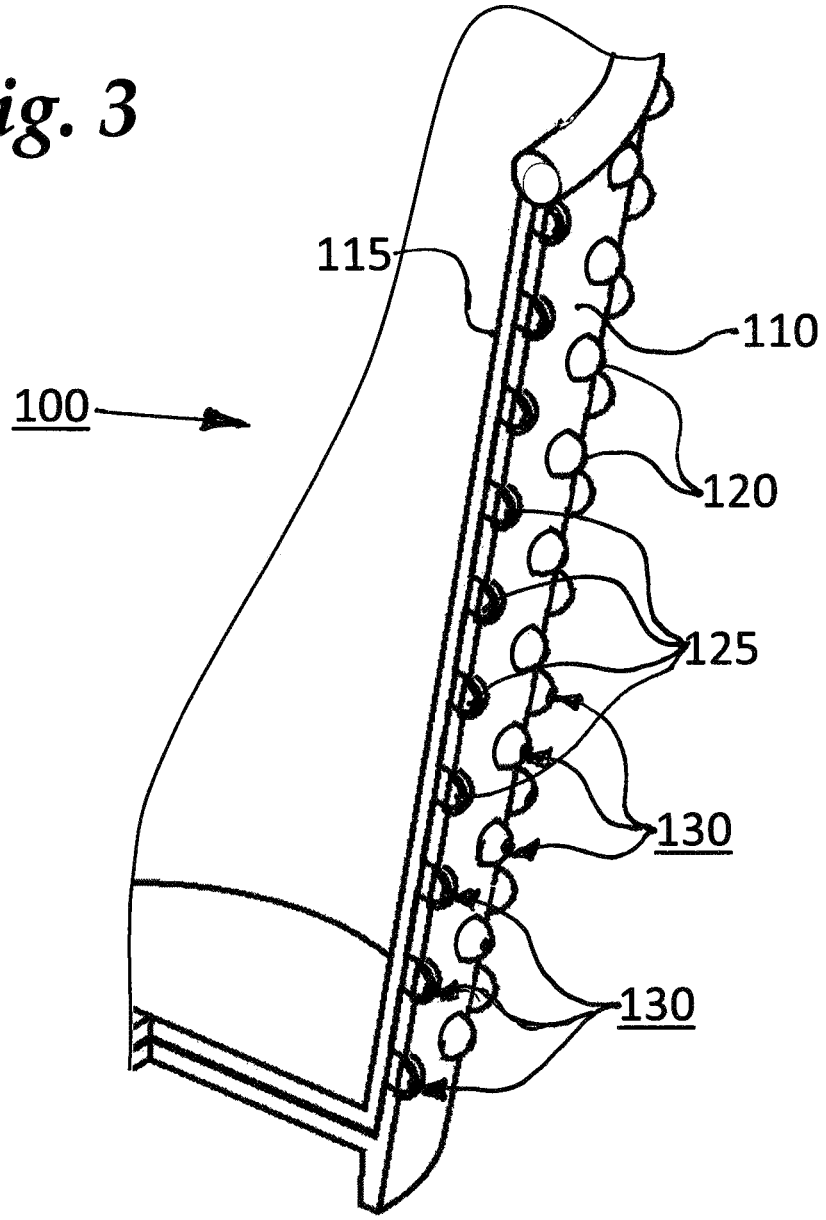
FIG. 3 is a partial cross-section of the beverage container with enzyme compartments.
Figure 4:
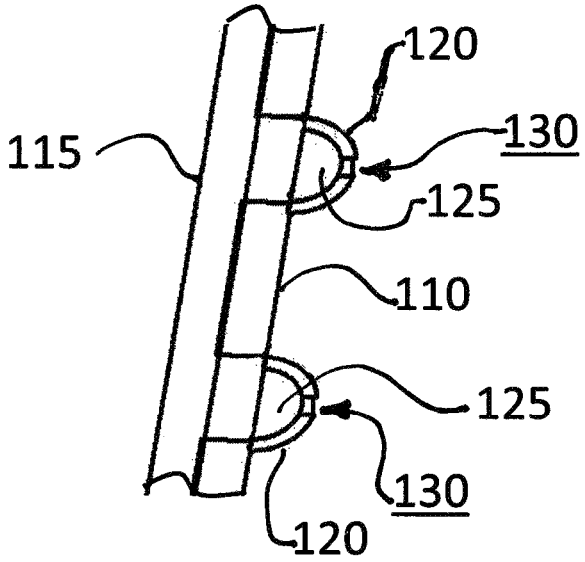
FIG. 4 is a partial cross-section of the beverage container with external enzyme compartments detailing construction of the compartments.

Referring to FIGS. 1, 3 and 4 container 100 comprises outer layer 110 and inner layer 115 both of which are made of chitin.

Outer layer 110 comprises essentially convex hemispheric hollow enzyme compartments 120 on its outer surface. Each compartment contains within enzyme 125 which can be exposed to the environment via opening 130 in outer layer 110.

Figure 5:
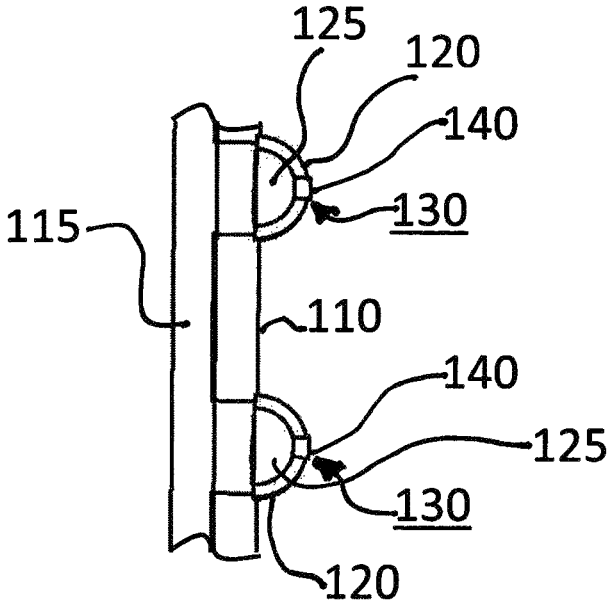
FIG. 5 is a partial cross-section of the beverage container with enzyme compartments detailing construction of the compartments with infiltration retardation features.

Referring to FIG. 5 in the container's enzyme compartment 120 opening 130 is obstructed with retardation plug 140 which retards activation of enzyme 125 and subsequent decomposition of container 100.

Figure 2:
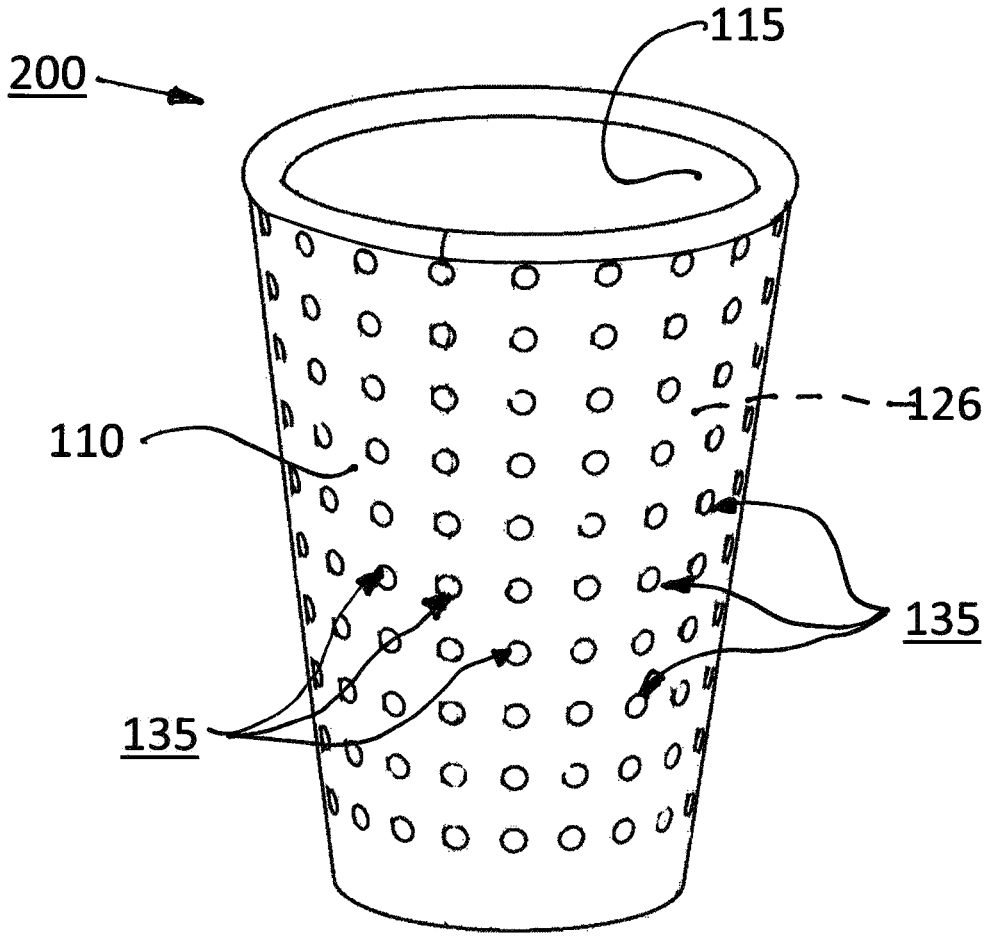
FIG. 2 is a perspective view of an alternative embodiment of the beverage container with internal enzyme layer accessible via infiltration channels in its outer layer.
Figure 7:
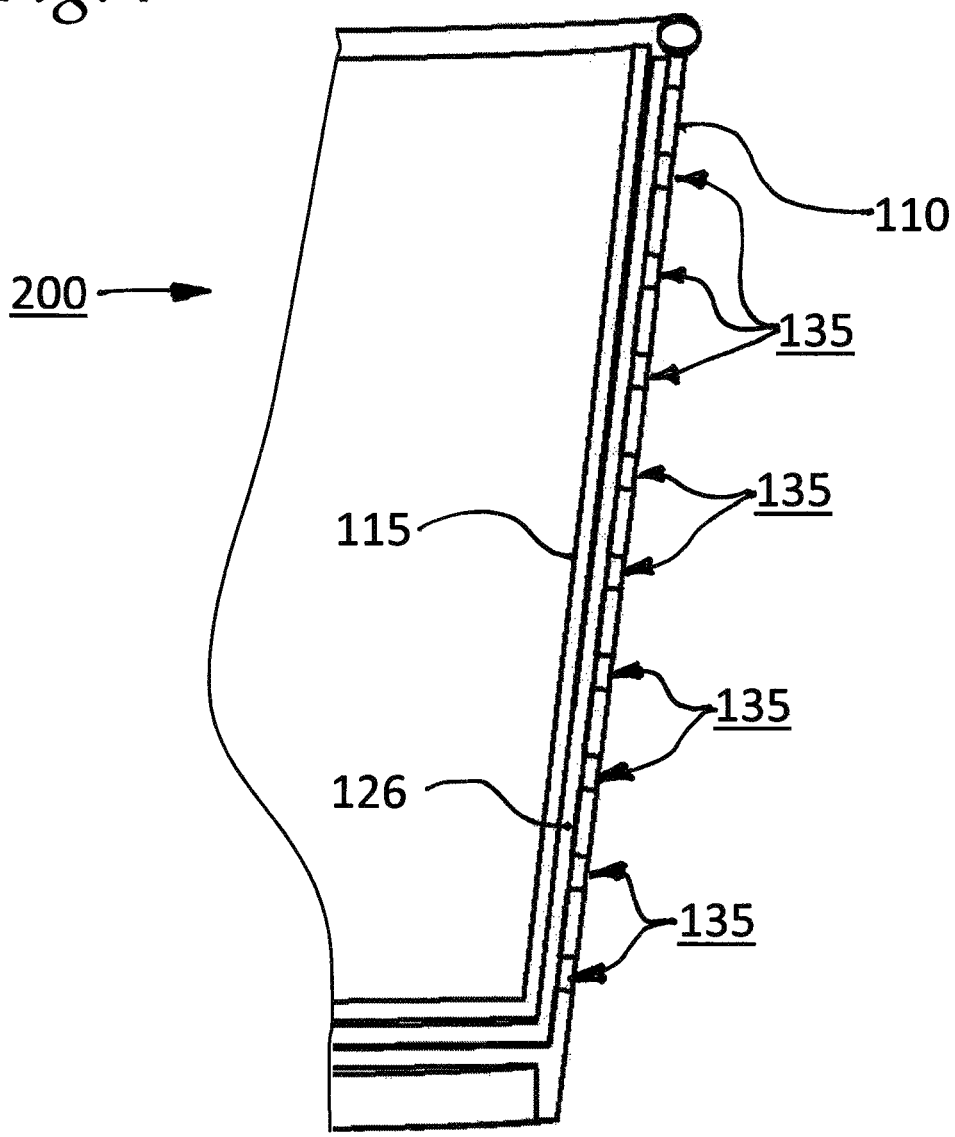
FIG. 7 is a cross-section of an alternative embodiment of the beverage container with enzyme layer accessible via infiltration channels in its outer layer.
Figure 8:
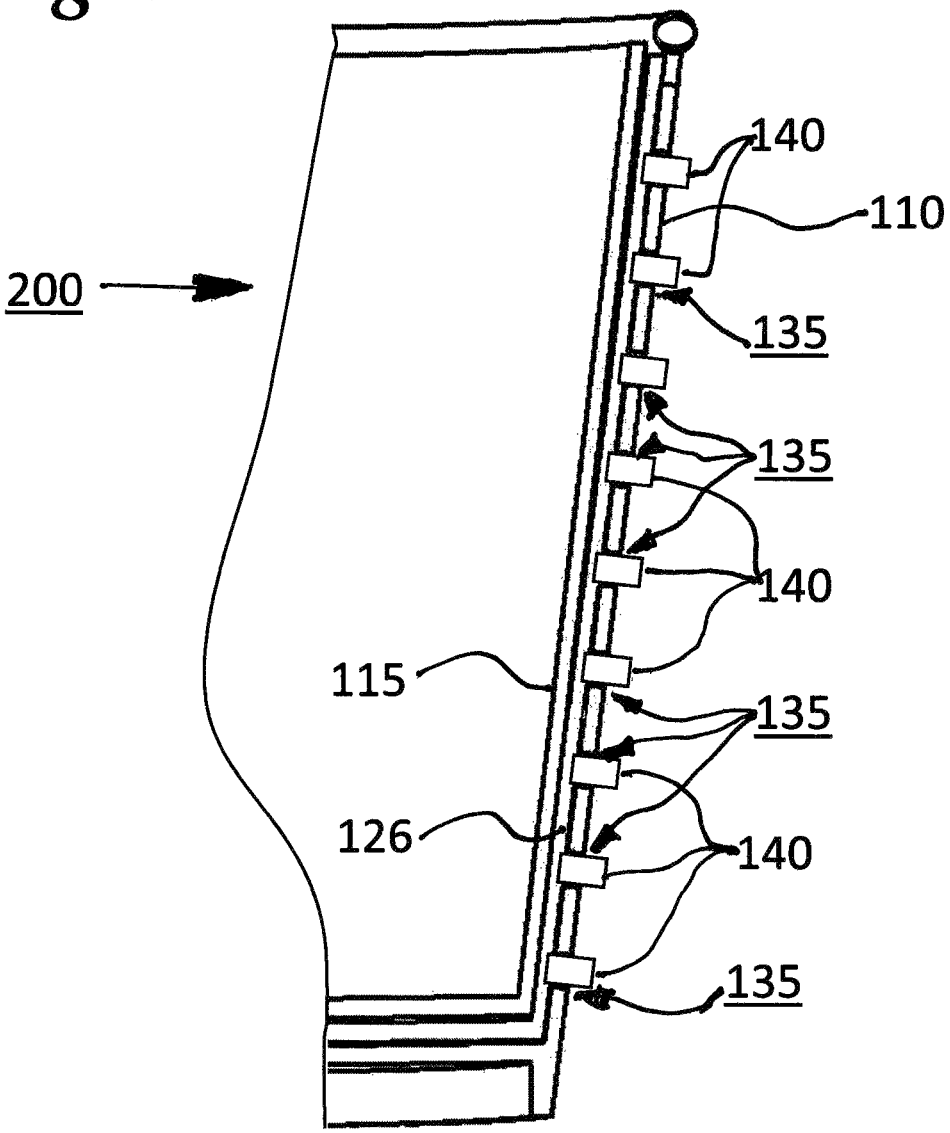
FIG. 8 is a cross-section of an alternative embodiment of the beverage container with enzyme layer accessible via infiltration channels in its outer layer, with additional infiltration retardation features present.

Referring to FIGS. 2, 7 and 8 beverage container 200 comprises an outer chitin layer 110, inner chitin layer 115 and enzyme layer 126. Enzyme layer 126 can be exposed to the environment via openings 135 in outer layer 110. Retardation plugs 140 can be inserted in openings 130 to delay enzyme activation and the resulting decomposition of the container.

Figure 6:
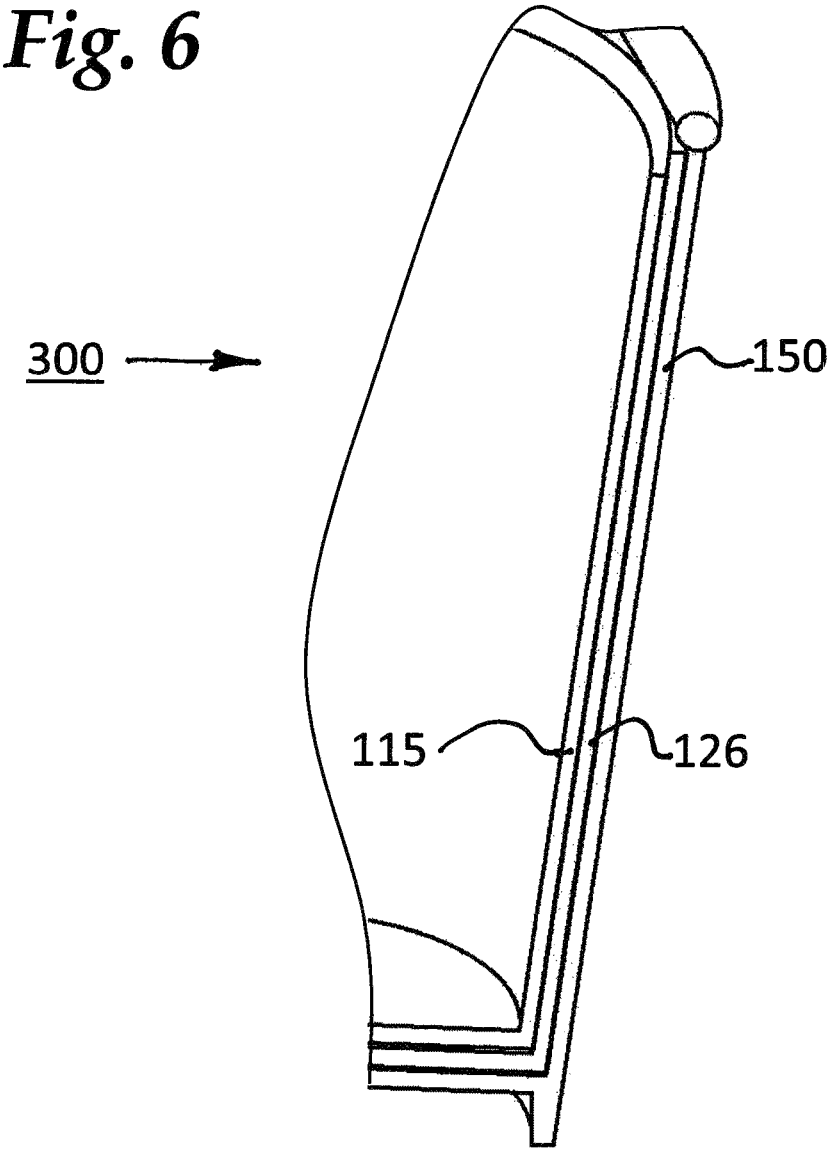
FIG. 6 is a cross-section of alternative embodiment of the beverage container with enzyme layer accessible via porous infiltration outer layer.

On FIG. 6 an alternative container embodiment 300 has an inner chitin layer 115, a porous layer 150 and an enzyme layer 126 interspersed between them. Porous layer 150 is made preferably of filter-type degradable paper.

Figure 9:
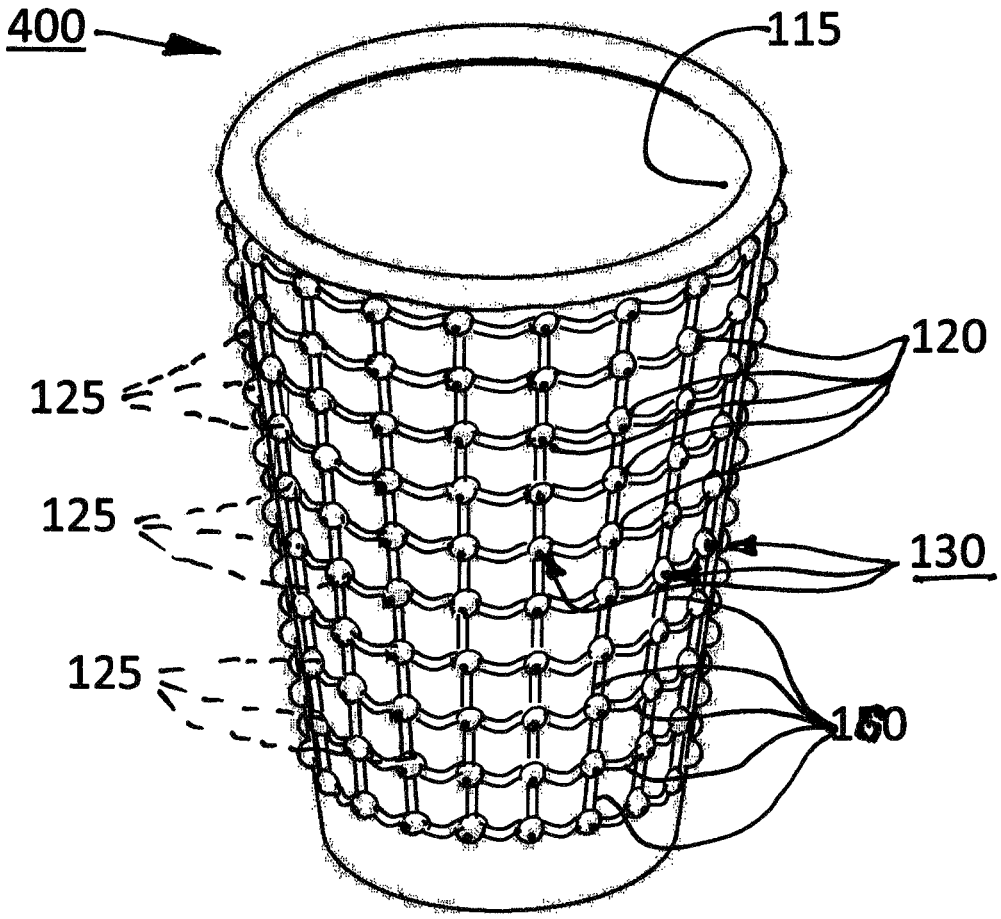
FIG. 9 is a perspective view of alternative embodiment of the beverage container with enzyme compartments interconnected by infiltration/spreading channels.

On FIG. 9 an alternative container embodiment 400 has, in addition to enzyme compartments 120 open to the environment interconnecting passages 160 which facilitate distribution of water and dissolved enzymes to speed up container degradation. Compartments 120 may also contain degradation retarding elements, as other embodiments described hereinabove.

Operation

Under normal operation, containers 200, 300 or 400 hold inside them water or other water- or oil-based foods virtually indefinitely thanks to the properties of their chitin inner layer 115. When discarded, containers are exposed to the environment where eventually they will be exposed to water.

Enzyme 125 is preferably a chitochinase-type enzyme or a combination of enzymes initially in an inactive dry ('lyophilized') state. Enzyme layer 126 is made of the same type of lyophized enzymes, either in powder, pressed layer or impregnated into a porous carrier layer. The chitochinase-type enzymes are well known in the art.

For example, some of the mostly studied chitochinase-type enzymes are those extracted from the fungi *Mucor rouxii, Absidia coerulea, Aspergillus nidulans* and *Colletotrichum lindemuthianum*. All these enzymes are glycoproteins and all exhibit very good thermal stability.

The chitochinase-type enzymes in lyophilized powder form are commercially available, for example Product C6137 'Chitinase from *Streptomyces griseus*' and Product C8241 'Chitinase from *Trichoderma viride*', both by Sigma-Aldrich, Inc. of Saint Louis, Mo., USA.

Upon exposure to water, the lyophized enzymes are activated and proceed to decompose the chitin layers of the container via hydrolysis of N-acetamido bonds in chitin which break down (acetylate) chitin and convert it to chitosan.

If a particular container is equipped with retardation devices such as plugs 140 made to dissolve or having controlled porosity, the ambient water first dissolves the plugs before reaching the underlying enzyme, or slowly penetrates them. This prevents premature enzyme activation from accidental contact with water or aqueous substances (e.g. user's hand sweat) during container use.

ADDITIONAL EMBODIMENTS

Although descriptions provided above contain many specific details, they should not be construed as limiting the scope of the present invention.

Disposable degradable cup lids are also possible with the underlying technology.

Various enzyme containment means, such as internal ribs, dividers, pockets and depressions can be added in the container. The dry enzyme layer can be 'painted' onto the inner surface of a porous substrate which in turn could be wrapped around the inner chitin container layer.

Retardation plugs can be made of a PVA (polyvinyl alcohol) material or similar, which dissolves in aqueous solutions, or a porous filter-type degradable paper.

Also several features of distinct embodiments can be combined.

Other articles can be made degradable using the technology described herein above, such as packaging and utensils.

A continuous degradable sheet of this material can be envisioned as well, usable protection from oil, water and weather when turned with chitin layer to the outside, to be degraded later by being reversed and exposed to ambient water.

Thus, the scope of this invention should be determined from the appended claims and their legal equivalents.

I claim:

1. A degradable container comprising an inner wall and an outer wall, wherein at least said inner wall comprises chemical compound containing chitin-type polysaccharide, wherein said outer wall comprises at least one internal compartment, said internal compartment containing chitin-degrading enzyme or enzymes, said enzyme or enzymes provided in inert form, said internal compartment further comprising at least one water ingress feature, wherein said inner wall of said container is degraded by said enzyme or enzymes when said enzyme or enzymes are activated by exposure to water entering said internal compartment via said water ingress feature from outside of said container and degrading said chitin-type polysaccharide.

2. The container of claim 1, wherein said water ingress feature comprises at least one water propagation channel, said channel communicating with environment outside said outer wall.

3. The container of claim 1, wherein said water ingress feature comprises an open aperture.

4. The container of claim 3, wherein said aperture further comprises at least one water ingress retardation element.

5. The container of claim 4, the retardation element further comprising a plug located inside said aperture.

6. The container of claim 5, the plug further comprising polyvinyl alcohol.

7. The container of claim 5, the plug further comprising a porous compound, said porous compound permeable by water, said porous compound comprising bio- or photo-degradable material or materials.

8. The container of claim 1, the outer wall including a plurality of the at least one internal compartments, the water ingress feature of each internal compartment comprising at least one water propagation channel, said channel communicating with environment outside said outer wall.

9. The container of claim 8, each of the plurality of internal compartments are connected by a plurality of environment connecting passages.

10. The container of claim 1, the outer wall including a plurality of the at least one internal compartments, the water ingress feature comprising an open aperture.

11. The container of claim 10, the aperture comprising at least one water ingress retardation element.

12. The container of claim 11, the water ingress retardation element comprising a plug.

13. The container of claim 12, the plug comprising polyvinyl alcohol.

14. The container of claim 12, the plug comprising porous structure, said porous structure permeable by water, said porous structure comprising bio- or photo-degradable compound or compounds.

15. A degradable container comprising an inner wall and an outer wall, wherein at least said inner wall comprises chemical compound containing chitin-type polysaccharide, a cavity between said inner wall and said outer wall, said cavity further containing chemical compound or compounds comprising chitin-degrading enzyme or enzymes, said enzyme or enzymes provided in inert form, said outer wall further comprises porous material, said material permeable by water, wherein at least said inner wall is degraded by said enzyme or enzymes when said enzyme or enzymes are activated by exposure to water entering said cavity via said porous material from outside of said container.

16. The container of claim 15, the material further comprising bio- or photo-degradable compound.

17. A degradable article comprising a first layer, whereby at least said first layer comprising chitin or chitin-containing compound or compounds, said article further comprising a second layer, said second layer comprising compound or compounds containing chitin-degrading enzyme or enzymes, said enzyme or enzymes supplied in inactive form, said second layer comprising at least one aperture for ambient water to ingress and contact said enzyme or enzymes, said enzyme or enzymes activated upon contact with said water, said enzymes subsequently degrading said chitin or chitin-containing compound or compounds in said first layer, said article being degraded thereby.

* * * * *